US005210383A

United States Patent [19]

Noxon

[11] Patent Number: 5,210,383

[45] Date of Patent: May 11, 1993

[54] SOUND ABSORBENT DEVICE FOR A ROOM

[76] Inventor: Arthur M. Noxon, 3690 County Farm Rd., Eugene, Oreg. 97401-4616

[21] Appl. No.: 733,446

[22] Filed: Jul. 22, 1991

[51] Int. Cl.[5] ..... E04B 1/82

[52] U.S. Cl. ..... 181/290; 181/291; 181/294; 181/295

[58] Field of Search ..... 181/295, 296, 284, 285, 181/286, 290, 291, 292, 293, 248, 249, 250, 251, 267, 294, 30

[56] References Cited

U.S. PATENT DOCUMENTS 1,811,762 6/1931 Schnell ..... 181/248

4,548,292 10/1985 Noxon ..... 181/295

FOREIGN PATENT DOCUMENTS 875482 8/1961 United Kingdom ..... 181/295

*Primary Examiner*—Donald A. Griffin

*Assistant Examiner*—Khanh Dang

*Attorney, Agent, or Firm*—James D. Givnan, Jr.

[57] ABSTRACT

A tubular sound absorbent device includes the cylindrical wall closed by top and bottom end walls to define an internal chamber. Located within the chamber are various sound wave attenuating devices including those of tubular configuration as well as those of frust-conical shape. The sound wave attenuating components may also include perforated tubes entirely confined within the sound absorbent unit or with a tube extending outwardly for termination in a companion structure.

6 Claims, 1 Drawing Sheet

SOUND ABSORBENT DEVICE FOR A ROOM

BACKGROUND OF THE PRESENT INVENTION

The present invention concerns sound absorbent structures for placement within a room to improve room acoustics by reducing audible low frequency sound waves.

In present use are devices, termed by the public sound traps, for enhancing room acoustics. Examples of such devices are disclosed in U.S. Pat. Nos. 2,502,020; 2,706,530; 2,160,638; 4,319,661 and 4,548,292 the latter issued to the present inventor. The general purpose of such sound absorbing articles is the reduction in low audible frequencies as at 250 HZ and below which degrade the acoustics of a room.

U.S. Pat. No. 4,319,661 discloses a pair of Helmholtz resonators disposed within a cylindrical housing filled with a mass of sound absorbent material. The resonators have outwardly orientated end surfaces each defining an opening proximate the end of the sound absorber unit. Wave access to the Helmholtz resonators is by way of acoustically porous end caps of the device.

SUMMARY OF THE PRESENT INVENTION

The present invention is embodied within a sound absorbent bass trap defining a chamber in which is housed a resonator serving to enhance low frequency absorption. The acoustic pressure within the device is reduced by being partially transformed into kinetic energy. Accordingly, acoustic back pressure within the sound absorbing device is reduced to increase the pressure drop across the wall of the sound absorber device.

In one embodiment a sound absorbing unit includes a cylindrical wall of acoustically porous fibrous material such as fiberglass with the unit in place on a walled support with an open ended tubular segment extending partially into the cylindrical and the walled structure. Other forms of the present invention include the above mentioned cylindrical unit provided with a perforate resonator lengthwise disposed in said unit while still another embodiment utilizes a hollow frusto-conical resonator. Provision is made for a tubular resonator extending through an end wall of a cylindrical sound absorbing unit and through, at least partially, a wall of a room to function as an acoustical vent. A still further form of the invention includes the above mentioned tubular unit which houses a segment of a tubular resonator having a closed end disposed exteriorly of the unit and support or base for the cylindrical unit.

Important objectives of the present invention is the increase in the efficiency of a sound absorber unit in place within a room by increasing the acoustical porosity and efficiency of a free standing sound absorbent unit by reducing back pressure therewithin; the provision of a sound absorber unit which includes internal tubular means both wholly as well as partially contained within the sound absorber unit to increase the capability of the unit to absorb frequencies of 250 HZ and below.

DETAILED DESCRIPTION OF THE PREFERRED EMBODIMENTS

Figures 1, 1A, 2, 3, 4, 5:
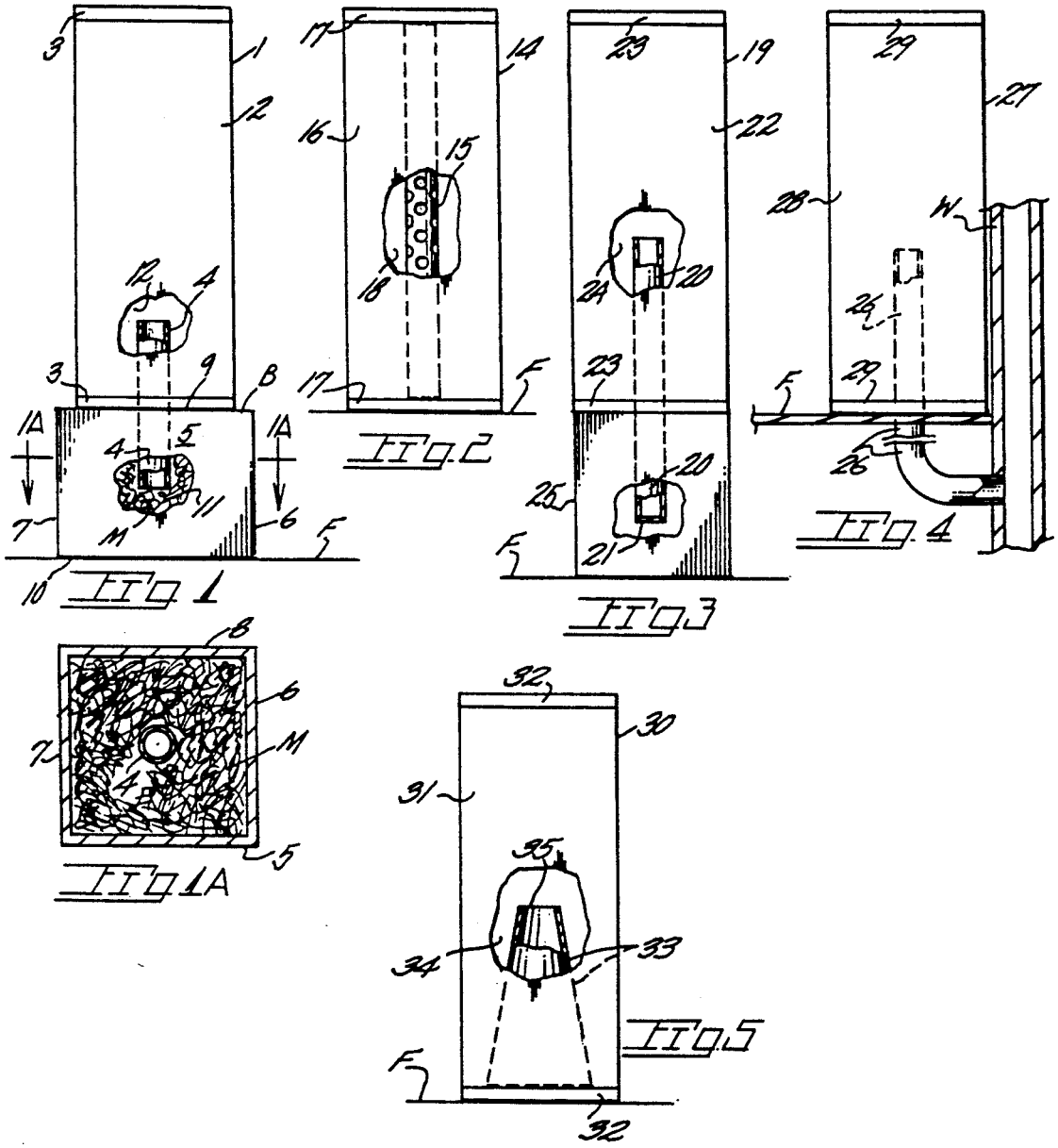
FIG. 1 is a front elevation view of the present sound absorber unit including a tubular vent terminating in a resonator of box configuration.
FIG. 1A is a horizontal sectional view taken along line 1A—1A of FIG. 1.
FIG. 2 is a front elevational view of a sound absorber unit having a perforate tubular resonator.
FIG. 3 is a front elevational view of a sound absorber unit equipped with a quarter wave tubular resonator having a remote closed end.
FIG. 4 is a front elevational view of a sound absorber unit equipped with a one-half wave length resonator in communication with a wall defined space.
FIG. 5 is an elevational view of a sound absorber unit equipped with an internal frusto-conical resonator.

With continuing attention to the drawings the reference numeral 1 indicates a sound absorber device which is of tubular configuration having an acoustically porous wall 2 of fibrous material. End walls are indicated at 3. The above described sound absorber device is generally of the type disclosed by reference to the present inventor's U.S. Pat. No. 4,548,292. A reflective sheet member may be incorporated into the porous wall structure to reflect wave frequencies above those to be dampened by the present structure. The above mentioned patented device does not include internal resonator means.

With attention again to FIG. 1, a box structure at B includes side walls 5, 6, 7 and 8 which along with top and bottom walls 9 and 10 define an internal area 11. An open-ended tube 4 communicates the chamber or interior 12 of the sound dampening device 1 with the interior space 11 of box structure B which is preferably occupied with a lightweight fiberglass material M to provide a simple Helmholz type resonator. Tube 4 is suitably affixed to an end wall 3 of sound absorbent device 1.

FIG. 2 discloses a perforate tubular resonator 15 extending the length of and centrally disposed within sound absorbent device 14 having a continuous wall 16 and end walls 17 of the type earlier described. The perforate tube is concentrically disposed within a chamber 18 of device 14 and provides a resonator of the distributed Helmholz type.

In FIG. 3 a standing wave reactive vent is disclosed at 20 which is closed at its lower end 21. A sound absorbent device 19 has a sound porous cylindrical wall 22, ends 23 defining a chamber 24. The resonator may be tuned by selection of its length being as for example a quarter wave resonator to adapt same to a particular frequency. A rigid walled support structure is at 25.

In FIG. 4, a pipe 26, for example, of one half wavelength is vented from a room to a neutral air space external to or isolated from the room as by a wall W. A room located sound absorbent device 27 has a cylindrical acoustically porous wall 28 and end walls 29.

FIG. 5 shows a sound absorbent device at 30 having a sound porous wall 31, end walls 32 with a resonator 33 of frusto-conical shape secured in place in the interior or chamber 34 of the device. Resonator 33 is of hollow construction and open at its lesser or distal end 35 and capable of a one-quarter wavelength resonance along with a lower frequency Helmholz type resonance for wider band performance.

The above described devices transform some of the acoustic pressure or potential energy fluctuations inside the bass traps into acoustic kinetic energy fluctuations. While the same amount of total acoustic energy remains inside the trap, its form changes. Venting the internal pressure fluctuations increases the pressure gradient across the resistive lining of the trap to enhance its sound absorbing capacity.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. A sound absorbent structure for placement in a room, said structure comprising, end walls and a continuous wall therebetween defining an elongate chamber, said wall being of a fibrous nature and acoustically permeable to sound wave frequencies below 250 HZ, and sound wave attentuating means of elongate tubular configuration and spaced inwardly from said continuous wall and at least partially disposed in said chamber and having an orifice in unrestricted communication with the chamber to reduce back pressure in the structure for the purpose of effecting a suitable pressure drop across said continuous wall.

2. The combination claimed in claim 1 wherein said attenuating means is a truncated hollow cone having a base in place on one of said end walls of the sound absorbent device.

3. The combination claimed in claim 1 wherein said attenuating means is a tubular member having a perforate wall and disposed in said chamber.

4. The combination claimed in claim 1 wherein said attenuating means is a tubular member having a closed end located exteriorly of said sound absorbent device.

5. The combination claimed in claim 1 wherein said attenuating means is a tubular member having an open end, a building wall structure, said open end of the tubular member located in an air space which is oppositely offset from said wall structure from said sound absorbent structure and hence isolated from the sound waves.

6. The combination claimed in claim 1 wherein said attenuating means is a tubular member terminating at an open end located exteriorly of said sound absorbent device, a rigid walled closed structure of a specific volume housing said open end of the tubular member, said tubular member and said rigid walled structure serving as a Helmholtz resonator.

* * * * *